US005444331A

United States Patent [19]

Matsuno et al.

[11] Patent Number: 5,444,331

[45] Date of Patent: Aug. 22, 1995

[54] DIELECTRIC BARRIER DISCHARGE LAMP

[75] Inventors: Hiromitsu Matsuno; Tatsushi Igarashi, both of Hyogoken; Tatsumi Hiramoto, Tokyo; Yasuo Oonishi, Hyogoken, all of Japan

[73] Assignee: Ushiodenki Kabushiki Kaisha, Tokyo, Japan

[21] Appl. No.: 184,143

[22] Filed: Jan. 21, 1994

[30] Foreign Application Priority Data

Jan. 20, 1993 [JP] Japan ..... 5-023536
Jan. 29, 1993 [JP] Japan ..... 5-032527
May 27, 1993 [JP] Japan ..... 5-146690

[51] Int. Cl.[6] ..... H01J 65/04; H01J 61/26

[52] U.S. Cl. ..... 313/553; 313/607; 313/634; 313/636; 501/54

[58] Field of Search ..... 313/493, 553, 561, 607, 313/631, 632, 634, 636, 317, 358, 234; 501/53, 54; 315/248, 344, 111.21

[56] References Cited

U.S. PATENT DOCUMENTS 3,984,727 10/1976 Young .
4,837,484 6/1989 Eliasson et al. .
4,945,290 7/1990 Eliasson et al. ..... 313/607 X
4,983,881 1/1991 Eliasson et al. ..... 313/607

FOREIGN PATENT DOCUMENTS 0509110 10/1992 European Pat. Off. .
0516376 12/1992 European Pat. Off. .
2-7353 1/1990 Japan .

OTHER PUBLICATIONS

"Modeling and Applications of Slient Discharge Plasmas", Eliasson, IEEE Trans., vol. 19, Apr. 2, 1991, pp. 309–323.

Electric Assoc. Revised Publ., "Discharge Handbook", vol. 7, publ. Jun. 1989, Reference p. 263.

*Primary Examiner*—Donald J. Yusko
*Assistant Examiner*—N. D. Patel
*Attorney, Agent, or Firm*—Keck, Mahin & Cate

[57] ABSTRACT

A dielectric barrier discharge lamp has a discharge vessel having a discharge chamber filled with a discharge gas. Excimer molecules are developed due to a dielectric barrier discharge. The discharge vessel is equipped with a window for the output of the light radiated from the excimer molecules. A getter space, equipped with a getter, communicates with the discharge chamber. A common wall separates the discharge chamber from the getter space, or a separately arranged getter space is connected to the discharge chamber via a tube. In one form, the discharge vessel and window is made of quartz glass containing less than 10 ppm of OH radicals by weight.

15 Claims, 3 Drawing Sheets

DIELECTRIC BARRIER DISCHARGE LAMP

BACKGROUND OF THE INVENTION

1. Field of the Invention

This invention relates to a dielectric barrier discharge lamp wherein utilization is made of an ultraviolet ray light source which utilizes optical reactions, and by which excimer molecules are created by the dielectric barrier discharge, utilization being made of the radiation emanating from the excimer molecules, e.g. for sterilization, curing of lacquers, etc., see U.S. Pat. No. 4,837,484 for other utilities.

2. Description of the Related Art

This invention is related to the technology revealed, for example, in Japanese unexamined patent publications 2-7353 wherein a discharge gas which forms excimer molecules is used to fill a discharge tube or container. Excimer molecules are formed by the dielectric barrier discharge (comprised of either an ozonizer discharge or a silent discharge, see ELECTRIC ASSOCIATION REVISED PUBLICATION "DISCHARGE HANDBOOK" VOL. 7 PUBLISHED IN JUNE OF 1989, REFERENCE PAGE 263). The light radiating from the excimer molecules is emitted from the discharge container, i.e. reference is made to a dielectric barrier discharge lamp. In addition, in Japanese unexamined patent 2-7353, reference is made to a discharge container (for example a fluorescent lamp) in which the ultraviolet rays within a dielectric barrier discharge lamp container are transformed into a visible light wave length by luminescence (such as through use of fluorescent bodies or powders). As indicated above, the dielectric barrier discharge lamp possesses a number of particular characteristics which do not exist in low pressure mercury discharge lamps or high pressure arc discharge lamps which are known under the prior art. However, such dielectric barrier discharge lamps have the deficiency that the light output of the lamp is reduced over the period of light usage. In other words, the life span is totally inadequate, and the discharge itself is unstable.

SUMMARY OF THE INVENTION

The invention is based on the object of providing a dielectric barrier discharge lamp in which substantially no decrease in the light output occurs during utilization and which has a sufficient characteristic throughout the lifetime as well as a stable discharge.

A principal object of the present invention is to provide a dielectric barrier discharge lamp which uses as a filler for a discharge tube or container a type of discharge gas which forms excimer molecules in the presence of a dielectric discharge; light or radiant energy radiates from the excimer molecules thus excited through an appropriate window. This is accomplished with the placement of a getter within the discharge container. The result of this arrangement is a dielectric barrier discharge lamp which manifests superior characteristics, and has greater longevity. The getter may be unattached to a component of the discharge container, or may be attached loosely to a component of the discharge container. The objective of the present invention can be accomplished by assuring that the getter is composed of at least one of several compounds, including a porous or powdered oxide, nitride or carbide. Titanium, barium or tantalum may also suffice.

It was discovered that, with the dielectric barrier discharge lamp, in comparison with the arc discharge lamps known under the prior art, there is a considerably greater proportional reduction in the output of ultraviolet light in the presence of impure gases, particularly oxygen, hydrogen, carbon monoxide, or water molecules. Although the exact mechanism is unclear, it is thought to be related to the fact that with a dielectric barrier discharge lamp, ultraviolet wavelengths can be efficiently produced which are not possible with the arc discharge lamps known under the prior art. The production of the ultraviolet waves is accomplished by means of the dielectric barrier discharge which produces a high energy plasma, unknown to occur with prior art arc discharge lamps. The plasma passes through various collision reactions, producing excimer molecules, one characteristic of which is the radiation of ultraviolet light. If impure gases, such as oxides, hydrogen, nitrides, carbon monoxide or aqueous molecular gases occur within the discharge space, not only do they directly break up the excimer molecules, but they also participate in the collision reaction process, reducing the number of excimer molecules, thereby further reducing the output of ultraviolet rays. In other words, in a dielectric barrier discharge, these impurities produce a greater proportional reduction in the output of ultraviolet rays than what is experienced in a prior art arc type discharge lamp.

With the placement of the getter within the discharge container, when lighting occurs, gaseous impurities such as oxygen, hydrogen, carbon monoxide, water etc., originating in the discharge container from the dielectric body or the electrodes or released by the action of the discharge plasma and/or the ultraviolet rays, are removed. The result is a long life dielectric barrier discharge lamp in which there is no substantial dilution of the concentration of the excimer molecules, and no substantial reduction in the strength of the light emanating from it.

One of the characteristics of a dielectric barrier discharge lamp is that it is capable of producing highly efficient wavelengths of light not possible with the arc type lamps known under the prior art. Although halogen is the preferred discharge gas, through the selection of at least one of several compounds including a porous or powdered oxide, a nitride, or a carbide, the penetration of the getter by the halogen gas will not occur. Moreover, since any impure gases are absorbed into the porous or powdered form, a dielectric barrier discharge lamp with superior longevity can be obtained.

The same objectives are achieved if titanium, barium or tantalum are used with halogen as the discharge gas.

According to another aspect of the invention, the inventive objective is attained by the fact that a dielectric barrier discharge lamp is comprised of a discharge vessel defining a discharge chamber which is filled with a discharge gas, that excimer molecules are produced due to a dielectric barrier discharge, that said discharge vessel is equipped with a window for the output of the light radiated from the excimer molecules, and that a getter space, which is equipped with a getter and communicates in a special way with the discharge chamber, is provided.

A further object according to the invention is to provide a construction in which a portion of the wall of the discharge tube container or vessel functions in common as a portion of a wall of the getter space, or that a separately arranged getter space is connected to the discharge chamber via a tube.

In addition, another object according to the invention is to provide a special sealable structure for filling or loading discharge gas into the previously evacuated chamber of the dielectric barrier discharge lamp and then to hermetically seal same. This special sealable structure preferably is a part of the getter space.

In accordance with a still further aspect of the present invention, the discharge container is comprised of quartz glass and is filled with discharge gas which produces excimer molecules by means of the dielectric barrier discharge in the container; the dielectric barrier discharge lamp is equipped with a window from which light radiating from the excimer molecules produced by the dielectric barrier discharge emanates; and the quartz glass utilized, at least for the window, includes less than 10 ppm of hydroxyl (OH) radical in terms of the weight of the quartz glass.

It was discovered that with a dielectric barrier discharge lamp, if impure gases such as oxygen, hydrogen, carbon monoxide, or water molecules were present, then the reduction in the output of the ultraviolet light rays was significantly greater than was the case with prior art glow discharge lamps or arc discharge lamps. The mechanism is not clear, but is thought to be due to the following. One of the characteristics of a dielectric barrier discharge lamp lies in the fact that it can produce ultraviolet ray wavelengths with high efficiency, which cannot be obtained with prior art glow lamps or arc lamps. In other words, dielectric barrier discharge lamps produce high energy plasma, which is not possible with prior art glow lamps or arc discharge lamps. This plasma sustains numerous collision reactions, thereby producing excimer molecules. One of the characteristics of the excimer molecules is the radiation of ultraviolet rays. Furthermore, if there is a presence in the discharge space of impure gases, particularly oxygen, hydrogen, carbon monoxide, or water molecules, then the excimer molecules are not only directly broken up, but though the action of a collision bombardment reaction, the number of excimer molecules is decreased, with a significant reduction in the output of ultraviolet rays. In other words, with a dielectric barrier discharge lamp, in comparison with a glow lamp or an arc discharge lamp, the proportional discharge and the output of ultraviolet rays is seriously affected by the presence of impure gases.

If a getter is attached within the discharge space of the container, then over the course of lighting usage, impure gases, such as, oxygen, hydrogen, carbon monoxide, or water molecules which originate in the container, or in the dielectric or electrode are removed, and there is no reduction in the concentration of excimer molecules. Furthermore, there is also no reduction in the output of light, and a dielectric barrier discharge lamp can therefore be offered which has a superior life span.

A further effect has been observed with prior arc discharge lamps. Systems which were secured to a discharge container comprising, for example, a zirconium and aluminum compound getter, which were too exposed to and came into contact with the discharge plasma experienced difficulties. In addition, a getter attached in too close proximity to the discharge plasma or, a getter membrane comprised of barium which had been steam adhered to the wall of the discharge container and came too closely into contact with the discharge plasma experienced difficulties. As a result of a substantive investigation, it was discovered that with such a dielectric barrier discharge lamp, when a getter was attached in the manner described, the discharge became unstable, and the light output also became unstable. In other words, with a dielectric barrier discharge lamp, since the discharge voltage is relatively high at several thousand volts, if a conductive getter was placed in too close proximity to the discharge plasma, then the light output became unstable. This seemed to be particularly true when the getter was steam adhered to the tube walls of the discharge container, when surface creepage seems to occur easily between the getter and the tube wall of the discharge container.

According to one aspect of the present invention, a construction is provided wherein a dielectric barrier discharge lamp is equipped with a window from which light emanates as radiation from the excimer molecules resulting from the utilization of a discharge gas in which excimer molecules are created by means of dielectric barrier discharge in the discharge container. There is conduction in the discharge space. The getter chamber is attached as a segregated component such that the getter chamber while exposed to the discharge space is not directly penetrated by discharge plasma. Consequently, getter material housed within the getter chamber, does not produce any abnormal discharge between the getter and the getter chamber which houses the getter and the discharge plasma. The light output is stably produced and a dielectric barrier lamp so constructed and arranged has a long useful life.

In addition, and in accordance with an embodiment of the invention, a portion of a wall comprising a boundary of the discharge chamber is built or arranged in common as a wall comprising a part of the boundary of the getter chamber. In this matter the objective of this aspect of the invention can be achieved without increasing the size of the lamp, and the lamp can be made small in size. In addition, by making the gap L (see FIG. 3) which connects the discharge chamber and the getter chamber to be less than twenty percent of the discharge gap D, there will not be any nonstandard or destabilizing discharge produced between the discharge chamber and the getter; by this construction, the light output will be stable, resulting in a dielectric barrier discharge lamp which has a long life.

Furthermore, and in accordance with another embodiment of the invention, the getter chamber can be constructed independently of the discharge container, and they can be interconnected by means of a tube communicating the discharge chamber and the getter chamber. By changing the length and the thickness of the tube, the influence of the discharge plasma on the getter can be controlled and a stable discharge can be achieved. Moreover, by this arrangement there is the added advantage of ease of construction. Furthermore, as is common practice the dielectric barrier discharge container (chamber) is first vacuum evacuated and then is filled with the discharge gas and finally sealed. According to a particularly efficacious structure of an embodiment at the present invention, a sealing tube is attached to or formed as part of the getter chamber, and the filling of discharge chamber takes place via the getter chamber. This obviates any need to add extra getter to the getter chamber, and this objective of the invention can be achieved while keeping the lamp small in size, and easy to construct.

BRIEF DESCRIPTION OF THE DRAWINGS

The above and other objects and features of the present invention will be clearly understood from the following description directed to preferred embodiments thereof when considered in conjunction with the accompanying drawings, in which.

DETAILED DESCRIPTION OF PREFERRED EMBODIMENTS

Figure 1:
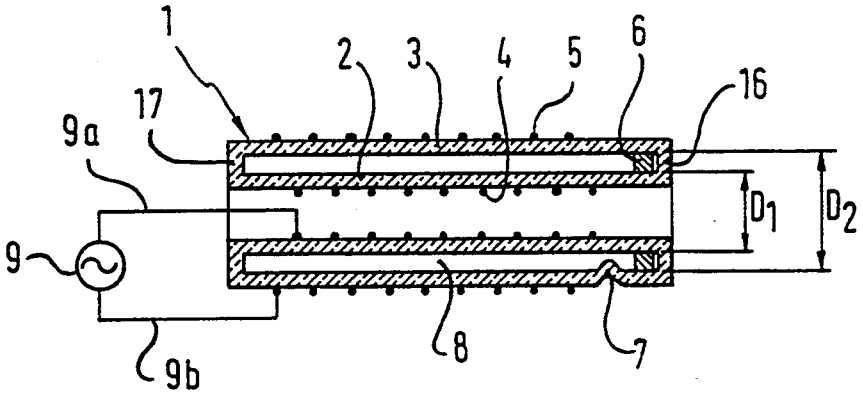
FIG. 1 is a view in axial section showing schematically an embodiment of a dielectric barrier discharge lamp in accordance with this invention.

Referring now to the drawings a detailed description of preferred embodiments will now be made. As shown, FIG. 1 portrays a primary preferred embodiment illustrating a hollow wall annular, right, circular in cross section, quartz cylinder 1 serving as the discharge container of the novel dielectric barrier discharge lamp described by this invention. The discharge container 1, shown in axial section, is manufactured or formed from quartz glass, is hollow and cylindrical in form, and has an overall length of 300 mm. It is formed by an internal tube 2, the external diameter $D_1$ of which is 6 mm, and an outer tube 3, the internal diameter $D_2$ of which is 8 mm. The inner tube 2 and the outer tube 3 concurrently or coaxially position the dielectric barrier and the light emitting window member. To the respective outer surfaces of tubes 2 and 3 are attached electrodes 4 and 5 which are formed of a conductive metallic network which is sufficiently open to allow emitted light to pass freely therethrough. Discharge space 8 is defined by the annular space between tubes 2 and 3 and is closed at each end by annular walls 15 and 16. A ring-shaped getter 6 is mounted in discharge space 8 at one end and is formed from a compound of aluminum and zirconium.

The movement of getter 6 within the discharge space 8 is prevented by an inwardly extending protrusion 7 which is formed in outer tube 3, and getter 6 is not otherwise secured to discharge container 1.

Xenon gas is used as the discharge gas to fill the discharge space 8, at a torr pressure of 100. Lighting is provided using an alternating electric current source 9 with leads 9*a* and 9*b* connected to mesh or network electrodes 4 and 5 respectively to input voltage at 0.2 watts per square centimeter of surface area. Through the adaptation of ring-shaped getter 6 to the cylindrical dielectric barrier discharge lamp, the size can be kept small, and a dielectric barrier discharge lamp can be provided which has long life.

Figure 2:
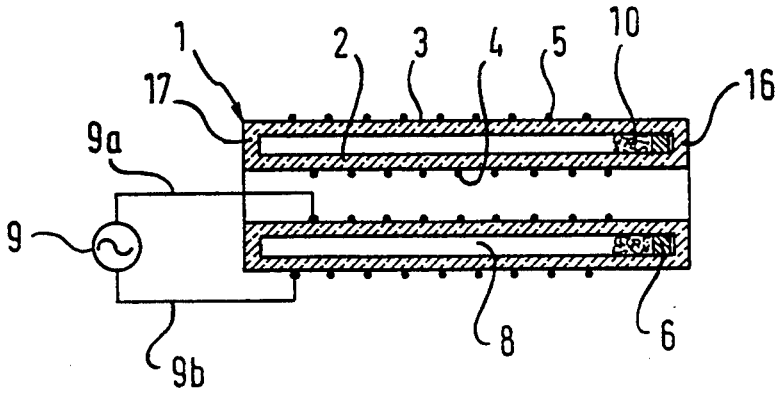
FIG. 2 is a view similar to that of FIG. 1 showing schematically another embodiment of a dielectric barrier discharge lamp in accordance with this invention.

FIG. 2 shows in axial cross section a second embodiment of the present invention. As shown, a tube shaped dielectric barrier discharge lamp 1 consists of the same construction and same materials and same shape as shown in FIG. 1. The same reference numbers refer to corresponding parts. In this embodiment, the ring-shaped getter 6 is loosely attached or secured to the discharge container 1, by means of a wad of quartz glass wool 10 fitted into the discharge space 8 between the getter 6 at one end and the rest of the discharge space 8. Glass wool 10 overlies the protrusion 7 which serves to anchor wad 10 and keep it from shifting laterally.

According to another embodiment of this invention, the internal diameter of the ring-shaped getter 6 used in the embodiments of FIG. 1 and FIG. 2 can be made slightly smaller than the external diameter of the inside tube 2. Moreover, the ring of the ring-shaped getter 6 can be cut across and opened before insertion into the inside tube 2. In this manner, the ring-shaped getter 6 will be secured to the outside surface of inside tube 2 through the elasticity of the ring-shaped getter 6.

In still another embodiment of the present invention, the getter 6 can be comprised of a compound composed of alumina powder and silica powder, porous in nature, and which is press-formed into the shape of a ring. An inorganic adhesive or binder comprised primarily of zirconia and sodium silicate (water glass) can be used to attach the getter to the outside surface of inside tube. In this embodiment, a compound gas comprised of chlorine and xenon gas was used as the getter discharge gas. Selecting such a discharge gas enables the getter not to be penetrated, thereby enabling a long-lasting dielectric barrier discharge lamp.

None of the above examples of dielectric barrier discharge ultraviolet radiation lamps contained fluorescent bodies.

However, dielectric barrier discharge ultraviolet radiation lamps containing such fluorescent bodies may also be used. Since fluorescent bodies placed in the discharge container are in powder form, they provide a relatively great surface area. The absorption of impure gases on the surfaces of these fluorescent powder bodies causes a getter effect. However, the magnitude of the getter effect is not too great. Nonetheless, the dielectric barrier discharge lamp according to the present invention which does not contain any fluorescent bodies in the discharge space, is particularly effective.

Figure 3:
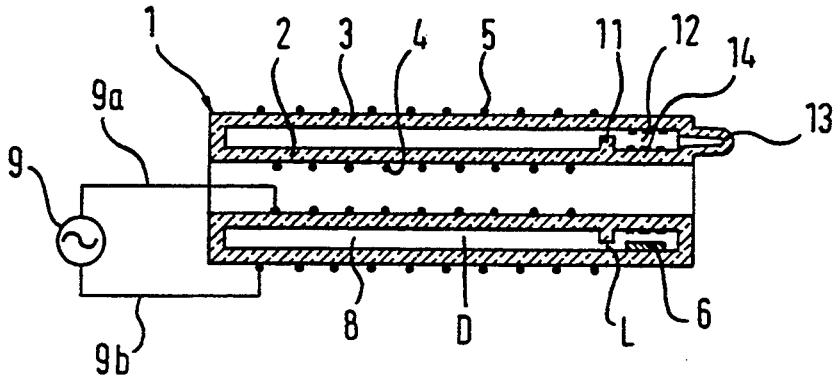
FIG. 3 is a view similar to that of FIG. 1 showing schematically yet another example of a dielectric barrier discharge lamp in accordance with this invention.

FIG. 3 schematically illustrates a further embodiment of a dielectric barrier discharge lamp with a coaxially cylindrical shape like FIG. 1 and FIG. 2 and according to the invention. Again like parts have been given corresponding reference numbers. In this embodiment a discharge vessel or container 1 consisting of a cylindrical hollow annular quartz glass has a total length of approximately 300 mm. The discharge vessel 1 has a hollow cylindrical shape defined by inner tube 2 with an outer diameter of 14 mm and outer tube 3 with an inner diameter of approximately 24 mm and a thickness of 1 mm. The tubes 2 and 3 are arranged coaxially, are hermetically sealed and define the annular discharge chamber or space 8.

The inner tube 2 and the outer tube 3 function as a dielectric barrier for the dielectric barrier discharge, as well as a light-emitting window. Electrodes 4 and 5 consisting of a net made of a metal wire in order to let the light penetrate are mounted on the exposed surfaces of tubes 2 and 3 and are connected by leads 9*a* and 9*b* to alternating electric current source 9.

The discharge gap D or diameter of the annular discharge space 8 thus amounts to 5 mm. On one end of the discharge vessel 1 is arranged a getter space or room 12 which is defined by one end of tubes 2 and 3 or by an extension of the tube walls of the discharge vessel 1. A circular annual partition or wall 11 is attached to the outer surface of tube 2 and extends toward tube 3 but terminates short thereof to define an annular gap L that defines or separates the getter space 12 from the rest of discharge space 8.

The getter space 12 is equipped with an exhaust tube 13 by means of which a barium getter 6 with a length of 5 mm is inserted into and encapsulated within the previously described getter space 12. The barium getter 6 is formed from a U-shaped metal trough having a groove with a width of 1 mm and a depth of 1 mm. The groove is filled with barium or a barium alloy.

As noted, getter 6 is inserted into space 12 via tube 13 which thereafter following loading of the discharge gas is hermetically sealed. After encapsulating the barium getter 6 in the getter space 12, the discharge vessel 1 is evacuated and a discharge gas is loaded, introduced, or otherwise encapsulated via tube 13, which thereafter is sealed by conventional means which becomes an integral part of the exhaust tube 13.

The barium getter 6, following encapsulation, is subsequently exposed to a high-frequency heating process such that a thin layer of barium 14 is formed on an inner wall of the getter space 12. The getter space 12 communicates with a discharge chamber 8 via gap L having a width of 0.8 mm, and the discharge chamber 8 is filled with xenon gas under a pressure of 300 Torr to serve as the discharge gas.

In tests, no discharge occurred between the electrodes 4 and 5 each consisting of a net made of a metal wire and the barium getter 6 or the thin layer of barium 14 while the previously described dielectric barrier discharge lamp was operated with an input power of 0.7 $W/cm^2$ area of the dielectric barrier discharge lamp supplied by alternating electric current source 9. The dielectric barrier discharge lamp was easily constructed, had a stable light output, a compact shape, and an excellent characteristic throughout its superior life span.

Figure 4:
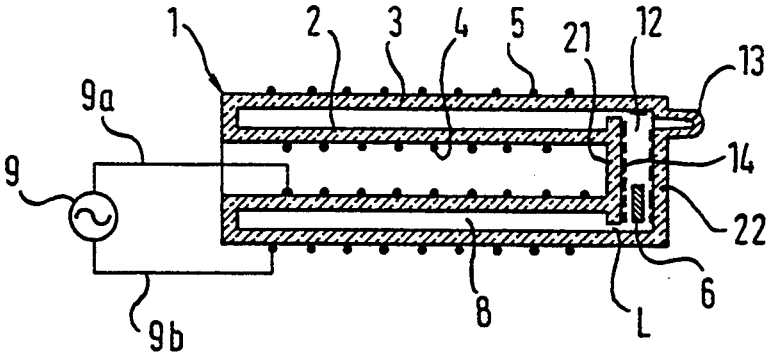
FIG. 4 is a view similar to that of FIG. 1 showing schematically a still further embodiment of the dielectric barrier discharge lamp according to the invention.

FIG. 4 schematically illustrates an additional embodiment of the dielectric barrier discharge lamp 1 of the same essential construction with the following modifications. The getter space 12 in this particular embodiment is constructed in such a way that a quartz disk 21 and a quartz disk 22 are connected or fixed or arranged on one end of the inner tube 2 and one end of the outer tube 3 such that they closely adjoin each other but are spaced apart to form getter space 12, while closing the ends of the tubes 2 and 3. The disk 21 forms a partition between the discharge chamber 8 and the getter space 12 and defines the annular gap L between getter space 12 and chamber 8. The disk 22 provides the mount for exhaust tube 13 and its associated hermetic seal. The dielectric barrier discharge lamp constructed according to this arrangement provides the advantage that the thin layer of barium 14 formed from getter 6 has a relatively large surface upon which it can be formed.

Figure 5:
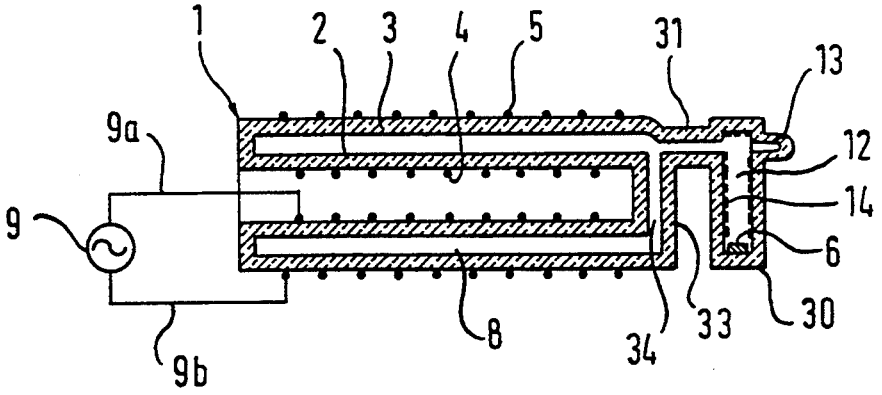
FIG. 5 is a view similar to that of FIG. 1 showing schematically an additional embodiment of the dielectric barrier discharge lamp according to the invention.

FIG. 5 schematically shows an additional embodiment of a dielectric barrier discharge lamp of the same essential construction with the following modifications according to the invention. According to this embodiment, a getter space 12 which is shaped like a hollow quartz disk or tube is arranged spaced from a lamp structure that includes quartz plates or disks 32 and 33, spaced apart, to close one end of tubes 2 and 3. Channel or manifold space 34 is formed at the end of lamp 1 by plates 32 and 33. A small diameter quartz tube 31 is integrally formed on one end of the discharge vessel 1 adjacent its periphery and connects with disk 30. Tube 31 connects or communicates space 34 with getter space 12. Discharge between the electrodes 4 and 5 and the barium getter 6 or the thin layer of barium 14 may be controlled in simple fashion by selecting the inner diameter and the length of the small diameter tube 31. This type of arrangement makes it possible to obtain a dielectric barrier discharge lamp with a stable light output.

According to an additional embodiment of the invention, in lieu of using the barium getter, a compound or alloy composed of zirconium and aluminum can be utilized as the getter material. No discharge occurred between the electrodes 4 and 5 and a zirconium-aluminum alloy getter when tested in a lamp 1, and a dielectric barrier discharge lamp with a stable light output was obtained.

The lamp 1 described in the previous embodiments is a dielectric barrier discharge lamp for emitting ultraviolet radiation. In none of the above examples was utilization made of fluorescent bodies. However, the previously described embodiments could possibly also utilize fluorescent bodies in the discharge lamp. Fluorescent bodies are used in powdered form and therefore, present a large surface area. This, in turn, results in a gettering effect due to the adsorption of gaseous contamination onto the surfaces of the fluorescent bodies. This, in turn, could have an effect and reduce the effectiveness of the getter (barium, Zr-Al, etc.). Accordingly, a dielectric barrier discharge lamp made and used in accordance with the essential teachings of the invention, that is, in which no fluorescent bodies are present within the discharge vessel, exhibits particularly strong effectiveness.

As previously noted, it has been discovered that with a dielectric barrier discharge, if impurities are present in the form of oxygen or hydrogen molecules, then the proportional reduction in the output of ultraviolet light rays is significantly greater than with arc type discharge lamps. Although the mechanism is unclear, it is thought to be due to the fact that a dielectric barrier discharge produces a highly efficient ultraviolet ray wavelength which is unobtainable with prior arc discharges. The production of the ultraviolet light rays is accomplished by the following mechanism. First, high energy plasma which is unavailable in prior arc lamps is produced by means of a dielectric barrier discharge. This plasma undergoes a number of collision bombardment reactions producing excimer molecules. These excimer molecules radiate ultraviolet light rays with a high degree of efficiency. Furthermore, if impure gases such as oxygen, hydrogen, or aqueous molecular gases are present in the discharge space, they directly break down the excimer molecules, and also are acted upon by the various bombardment collision reactions, thereby reducing the number of excimer molecules. In other words, if the concentration of excimer molecules is reduced, then the output of ultraviolet rays is also reduced. Particularly, if halogen is included in the discharge gas, then if there is an output of oxygen or water, there will be a deterioration of halogen relative to the quartz glass, and the reduction in the output of ultraviolet rays will be significant. In other words, with a dielectric barrier discharge lamp, in the presence of impure gases, the proportional reduction in the output of light is significantly greater than in comparison with the prior arc type lamps.

As a result of studies undertaken, it was discovered that the quartz glass utilized in the window which emanates the light from the dielectric discharge was a primary source of impure gases. Particularly, if the concentration of the OH radical within the quartz is great, then the discharge of water is also great. If the Si-OH bond affected by the ultraviolet light rays (hereafter referred to as an oxygen bond) is broken, OH is discharged as $H_2O$. After examining various types of quartz glass, it was discovered that a reduction in the concentration of the excimer molecules, accompanied by a reduction in the output of light, can be prevented through the utilization of a quartz glass in which the OH concentration was less than about 10 ppm by weight.

Figure 6:
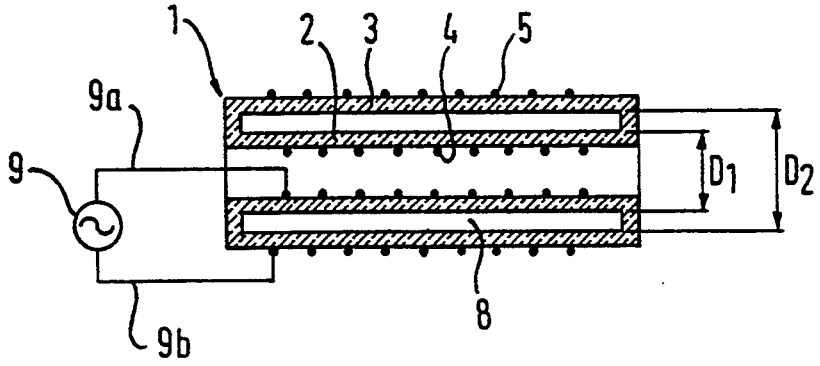
FIG. 6 is a view similar to that of FIG. 1 showing schematically yet another additional embodiment of the dielectric barrier discharge lamp according to the invention.

FIG. 6 shows a dielectric barrier discharge lamp 1 which comprises a hollow-wall, annular, right circular cylindrical quartz glass container having an overall length of 300 mm. The inner tube 2 has an external diameter $D_1$ of 6 mm, and the external tube 3 has an internal diameter $D_2$ of 8 mm, both being arranged on the same axis, and sealed at their ends to define the annular cylindrical discharge space 8. The inner tube 2, and the external tube 3 comprise the window from which emanates the dielectric barrier discharge of ultraviolet rays. The quartz glass includes an amount of the OH radical which is less than about 10 ppm by weight. Electrodes 4 and 5 are attached which are formed from a metallic compound network through which light permeates to the outer surface of the outside tube 3. The discharge space 8 is filled with xenon and chlorine which comprises the discharge gas. Furthermore, if the dielectric barrier discharge lamp is lit by means of an alternating electric source 9, then the amount of impurities being discharged from the quartz glass will be small. Furthermore, the corrosion caused by the chlorine relative to the quartz glass is minimal, and since the concentration of the excimer molecules within the discharge space 8 can be maintained at a high level, then a dielectric barrier discharge lamp 1 which has a small reduction in light output can be obtained.

Quartz glass lamps were manufactured with varying amounts of OH radicals. After being lit for 100 hours, if the value of the output light is given as 100, then the results of measurements taken of the attenuation rate of the excimer light after 1,000 hours can be explained. The lamp utilized is a dielectric barrier discharge lamp 1 of the constructional type shown in FIG. 6. As a result, it was confirmed that if the amount of OH radical within the quartz exceeds about 10 ppm by weight, then the light attenuation rate ranged from 30 to 60 percent. Conversely, if the OH radical was present in an amount less than about 10 ppm by weight then it was less than 20 percent which is a relatively effective measure of the lamp.

With this invention, as described above, with the passage of light usage, there was little reduction in the light output caused by the deterioration attributable to the influence of halogen on the quartz glass which forms the window through which the light rays emanate. Furthermore, the invention enabled a dielectric barrier discharge lamp which prevents the reduction in the concentration of excimer molecules which include halogen.

The previous description teaches that dielectric barrier discharge lamps made according to the various constructions of the invention have stable discharge, stable light output, and do not manifest any substantial reduction of the light output during their burning time such that a sufficient characteristic throughout the lifetime is ensured.

It is to be understood that although preferred embodiments of the invention have been described, various other embodiments and variations may occur to those skilled in the art. Any such other embodiments and variations which fall within the scope and spirit of the present invention are intended to be covered by the following claims.

What is claimed is:

1. In a dielectric barrier discharge lamp wherein the discharge container is filled with a discharge gas in which excimer molecules are formed by means of a dielectric discharge and which has a window for transmitting a light generated from the excimers, the improvement comprising a getter positioned in the discharge container exposed to the discharge gas.

2. In a dielectric barrier discharge lamp according to claim 1, wherein the getter is unattached to the discharge container.

3. In a dielectric barrier discharge lamp according to claim 1, wherein the getter is loosely attached to the discharge container.

4. In a dielectric barrier discharge lamp according to claim 1, wherein the getter is comprised of a material selected from the group consisting of porous or powdered oxide, nitride, carbide, and combinations thereof.

5. In a dielectric barrier discharge lamp according to claim 1, wherein the getter is composed of a material selected from the group consisting of titanium, tantalum, aluminum, barium, and combinations thereof.

6. In a dielectric barrier discharge lamp according to claim 1, wherein a halogen constitutes at least part of the discharge gas.

7. In a dielectric barrier discharge lamp in which a discharge vessel defining a discharge chamber is filled with a discharge gas that produces excimer molecules due to a dielectric barrier discharge, said discharge vessel being equipped with a window for the output of light radiated by the excimer molecules, the improvement comprising a getter space being provided, a getter located in said getter space and means communicating the discharge chamber with the getter space such that substantially no discharge plasma penetrates into the getter space.

8. In a dielectric barrier discharge lamp according to claim 7, wherein a wall common to the discharge vessel and getter space is provided, said wall defining the communicating opening between the getter space and discharge chamber.

9. In a dielectric barrier discharge lamp according to claim 7, wherein the getter space is connected to the discharge chamber via a tube.

10. In a dielectric barrier discharge lamp according to claim 7, wherein filling means is provided for introducing discharge gas into the discharge chamber via the getter space and includes an hermetic seal.

11. In a dielectric barrier discharge lamp, in which a discharge vessel is filled with a discharge gas that forms excimer molecules by means of a dielectric barrier discharge, and which is provided with a window from which the light that has been radiated by the excimer molecules exits, the improvement comprising the window consisting at least in part of quartz glass having a content of OH radicals less than about 10 ppm by weight.

12. In a dielectric barrier discharge lamp having a vessel which is filled with a discharge gas converted to excimers by a dielectric barrier discharge and which has a window for transmitting a light generated from said excimers, the improvement comprising a getter room communicating with the discharge space and the getter disposed in a getter room.

13. In a dielectric barrier discharge lamp as recited in claim 12, the improvement further comprising an hermetic seal sealing an entry into the getter room.

14. In a dielectric barrier discharge lamp as recited in claim 12, the improvement further comprising a tube communicating the discharge space and the getter room.

15. In a dielectric barrier discharge lamp as recited in claim 12, the improvement further comprising a partition which defines a gap communicating the discharge space and the getter room, said gap suppressing the penetration of dielectric barrier discharge into the getter room.

* * * * *